US005458340A

United States Patent [19]

Jackson

[11] Patent Number: 5,458,340

[45] Date of Patent: Oct. 17, 1995

[54] GOLF SWING TRAINING DEVICE

[76] Inventor: William G. Jackson, 7801 E. Rovey, Scottsdale, Ariz. 85253

[21] Appl. No.: 380,291

[22] Filed: Jan. 30, 1995

[51] Int. Cl.[6] ..... A63B 69/36

[52] U.S. Cl. ..... 273/191 B

[58] Field of Search ..... 273/191 R, 191 B, 273/186.1, 186.2

[56] References Cited

U.S. PATENT DOCUMENTS

| | | | |
|---|---|---|---|
| 2,655,378 | 10/1953 | Sheffer | 273/191 B |
| 2,788,214 | 4/1957 | Tilden | 273/191 B |
| 2,848,234 | 8/1958 | Brandon | 273/191 B X |
| 3,231,281 | 1/1966 | Wallo | 273/193 |
| 3,400,933 | 9/1968 | Heiser | 273/186 |
| 3,428,325 | 2/1969 | Atkinson | 273/186 |
| 3,462,156 | 8/1969 | Gentry | 273/191 B X |
| 3,604,712 | 9/1971 | Prior et al. | 273/186.1 |
| 3,762,719 | 10/1973 | Smith | 273/183 B |
| 4,486,020 | 12/1984 | Kane et al. | 273/191 R |
| 4,569,525 | 2/1986 | Folger | 273/186 A |

FOREIGN PATENT DOCUMENTS 244863 5/1963 Australia .

*Primary Examiner*—William H. Grieb
*Attorney, Agent, or Firm*—Warren F. B. Lindsley

[57] ABSTRACT

A practice device comprising a simulated golf club that is swung by a practicing golfer under the control of a sling that is anchored to a vertical wall. A proper swing is achieved when the sling is maintained in a taut condition throughout the course of the swing.

5 Claims, 2 Drawing Sheets

35
34
36
32
33
13
14
16
34
35
36
32
31
38
33
A
37
26
A'
27

14
16
35
34
36
32
38
33
A
B
37
26
A'
B'

34
35
36
32
38
33
C
37
A
26
27
C'
A'

17
18
34

30
23

32
30
38
A
33
31
39
40
26
29
27
28
A'

GOLF SWING TRAINING DEVICE

BACKGROUND OF THE INVENTION

This invention relates to improvements in golf training apparatus, and more particularly to exercise equipment for aiding a user in training his or her muscles to perform a golf swing exactly as desired in regular golf play.

Many varied forms of golf teaching and practicing devices are known in which a restraining means of some form is utilized to force the golf club head and shaft to swing in a circular path, such forms including restraining members attached to the club head attempt to cause the golfer to swing the club correctly. However, these devices do not accomplish the desired results since they are based on an incorrect theory of the correct and proper swing. They incorrectly assume that the golf swing is a single arc with the club head swinging or rotating around a center located at or near the player's shoulders and neck.

A proper swing involves a number of factors, including the grip, the position and motion of the arms and body, the angle at which the face of the club strikes the ball, and the velocity and momentum of the head of the club at impact. A satisfactory realization of all these considerations is dependent upon the complete path of the swing, including address, backswing, downswing, follow through and centrifugal balance of the golf club.

More specifically, the body and arms of the golfer together with the club, must move as a unit in a given plane throughout the course of the swing in a smooth and controlled rotational maneuver. There must be at all times a proper and controlled angular orientation of the shaft of the club with the arms of the golfer in which the club becomes an extension of the arms.

Instructional materials are readily available to players wishing to improve their skills, but it is one thing to be informed, and yet another to put the recommended techniques into practice.

DESCRIPTION OF THE PRIOR ART

A number of devices for use in practicing the golf swing are described below, however none disclose the new and novel exercising equipment claimed herein for perfecting a desired golf swing.

U.S. Pat. No. 2,655,378 discloses a golf club training device comprising a first flexible line 22 and a second flexible line 20 which forms an isosceles triangle with the shaft of the club.

U.S. Pat. No. 2,788,214 discloses a similar golf training device wherein the hands of the user are at a point midway between the attachment of the ends of the first line.

U.S. Pat. No. 3,231,281 discloses a golf club having interconnectable parts.

U. S. Pat. No. 3,400,933 discloses a golf practice device comprising universal connections between rod 27 and golf club 24 in order to provide proper guidance of the club head during the swing.

U. S. Pat. No. 3,428,325 discloses a golf swing training device comprising a cylindrical head casing 30 formed of a soft cellular material such as plastic or rubber which may strike the user without discomfort.

U.S. Pat. No. 3,762,719 discloses a golf instruction device in the form of a signal body of negligible weight adapted to be secured to the back of the lower forearm or to the back of the hand upper most on the club grip to provide a proper indication of proper hand position at the address and during the golf swing.

U.S. Pat. No. 4,569,525 discloses a simulated golf club which teaches and provides the user with instant visual indication of proper and improper position of the club throughout the swing, from address, backswing, downswing and follow-through.

SUMMARY OF THE INVENTION

In accordance with the invention claimed, a new and improved exercising device or training aid is provided for use by a golfer in the development of a proper stance and swing.

It is, therefore, one object of this invention to provide a new and improved exercising device and method of operation for use by golfers.

Another object of this invention is to provide an exercising device designed to train the muscles of a golfer to produce an arcuate movement or pattern of motion of the golf club in a perfect swing plane throughout the full course of the swing and also centrifugally balancing the golf club on that perfect swing plane.

A further object of this invention is to provide such a practice device in a form that provides both visual and tactile feedback so that the user immediately is aware of any serious departure from a desired form.

A still further object of this invention is to provide an exercising device that may be used in-doors and out-of-doors which will teach and exercise the user's muscles in the correct swing plane.

A still further object of this invention is to provide such a practice device in a simple and inexpensive form that is readily affordable by the average golfer.

Further objects and advantages of the invention will become apparent as the following description proceeds, and the features of novelty which characterize the invention will be pointed out with particularity in the claims annexed to and forming a part of this specification.

BRIEF DESCRIPTION OF THE DRAWINGS

The present invention may be more readily described by reference to the accompanying drawings, in which.

DESCRIPTION OF THE PREFERRED EMBODIMENT

Figure 1:
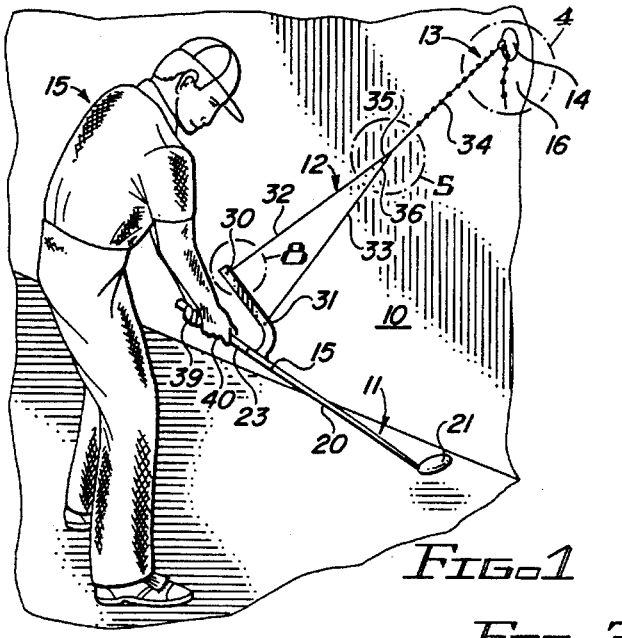
FIG. 1 is a perspective view of a golfer holding a golf swing training device embodying the invention.

The apparatus disclosed herein comprises exercise equipment designed to train the user's muscles to perform a given planar swing of a golf club to obtain the most effective results.

If properly used, this equipment can create a perfect swing plane that keeps the club centrifugally balanced on this swing plane throughout the entire swing of a user. The golf swing is a single arc with the club head swinging or rotating around a balance point positioned between the hands of the user. If the balance point moves from between the hands of the user to either side thereof the user may vary the position of the equipment to compensate therefor as hereinafter explained.

Referring more particularly to the drawings by characters of reference, FIGS. 1–5 disclose a golf swing training and exercising apparatus or device 10 embodying the invention and comprising a simulated golf club 11, a lanyard or sling 12 and an anchoring means 13 which may include a suction cup 14 in the hands of a golfer 15.

Figures 5, 6, 7A, 7B, 7C, 8, 9:
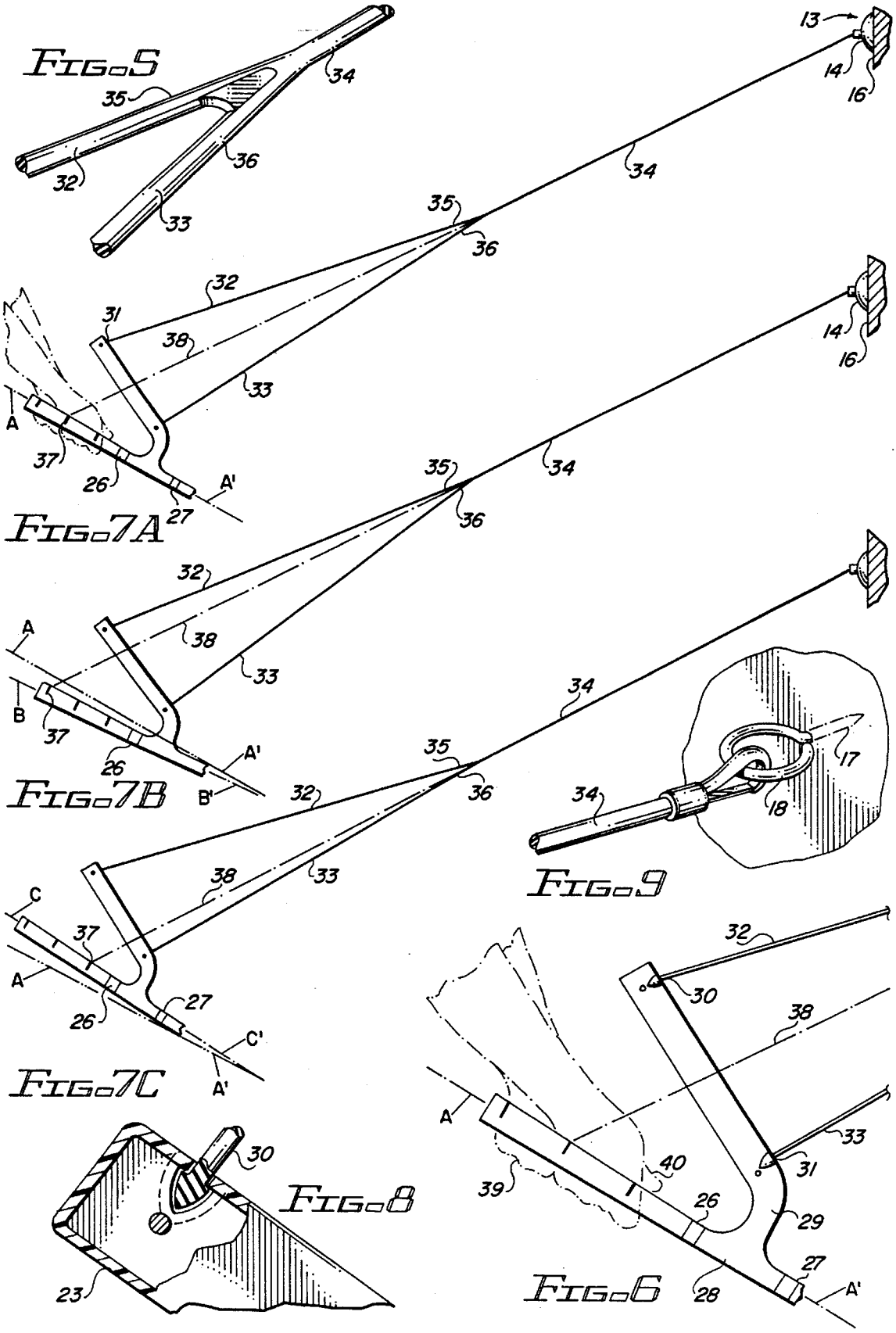
FIG. 5 is an enlargement of the circled area marked 5 in FIG. 1.
FIG. 6 is a partial perspective view of the golfer's hands engaging the training device and showing axis A–A' through the shaft of the training device.
FIGS. 7A–7C illustrate various positions of the axis of the training device relative to the position of the guide lines attaching the training device to a stationary surface.
FIG. 8 is an enlargement of the circled area marked 8 in FIG. 1.
FIG. 9 illustrates an alternative way of attaching the training device to a vertical wall.

Device 10 is anchored through anchoring means 13 to a post, mirror or vertically positioned wall 16 near its upper end and may comprise a suction cup 14 as shown in FIG. 1 or a ring bolt 17 providing an eye 18 for attaching sling 12 to wall 16 as shown in FIG. 9.

The simulated golf club 11 comprises a first hollow shaft portion 20 having a golf club head 21 at one end thereof and a second hollow portion 22 comprising a hand gripping means 23 at the other end.

Interconnecting the hand gripping means and the upper end of shaft 20 is a bracket or line guiding means 24. This line guiding means 24 comprises a hollow cylindrical member 25 that is axially aligned with shaft portions 20 and 22 and connected thereto by collars 26 and 27 forming a part of member 24.

Collars 26 and 27 are rotatably connected to portion 28 of member 25 so that the line guiding means 24 may rotate relative to shaft portions 20 and 22.

Figure 3:
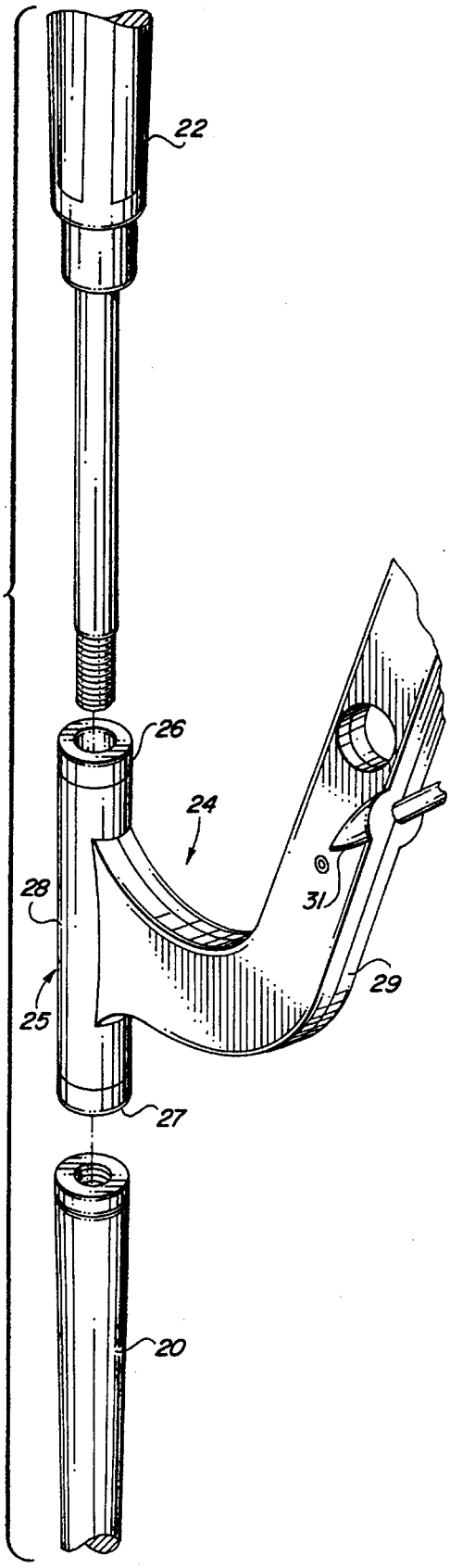
FIG. 3 is a partial exploded view of the golf swing training device of FIG. 1.

Line guiding means 24 further comprises an arm member 29 extending laterally from portion 28 of member 25 for providing a means for spacedly attaching the ends 30 and 31 of lines 32 and 33 of sling 12 thereto, as shown in FIGS. 1, 3 and 8.

Thus, portion 28 of member 25 may rotate relative to shaft portions 20 and 22 during the motion of the swing of a golfer.

Sling 12 further comprises a line member 34 connected to the interconnection of other ends 35 and 36 of lines 32 and 33.

Sling 12 may be formed of a first flexible line, the ends of which are spacedly attached to arm member 29 along its length and a second flexible line 34 one end of which is attached to the first line (32, 33) midway between its ends with its other end anchored to a vertical surface.

In the use of the golf swing training device, the upper end of line 34 is first anchored to a vertical surface using suction cup 14 or the ring bolt 17 and eye 18 shown in FIG. 9.

A full length mirror is an ideal surface for such mounting because of the visual feedback it affords during practice.

Figure 2:
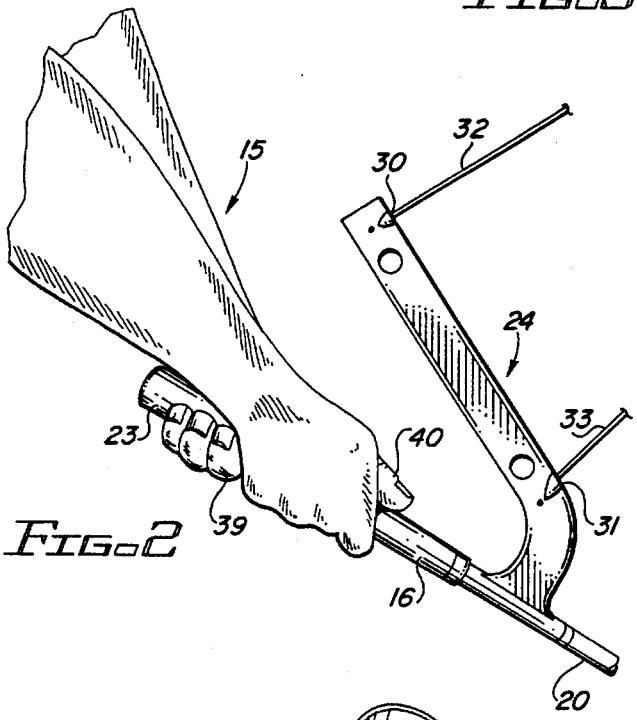
FIG. 2 is a partial cut-away view of a portion of the golfer's arms holding the golf swing training device.
Figure 4:
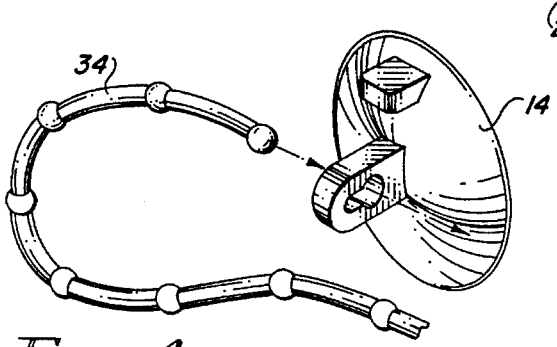
FIG. 4 is an enlargement of the circled area marked 4 in FIG. 1.

As shown in FIGS. 1–3, ends 30 and 31 of lines 32 and 33 of sling 12 are suitably secured to arm member 29 in a spaced arrangement. The other ends 35 and 36 of lines 32 and 33 are suitably attached to one end of line 34 with its other end connected to suction cup 14.

When the golfer 15, shown in FIG. 1, grasps the hand gripping member 23 of the simulated golf club 11 and assumes the position thereshown, lines 32 and 33 with arm member 29 form an equilateral triangle and when the lines 32 and 33 are equally tensioned, a balance point 37 of the club occurs along the axis 38 of the triangle, shown in FIG. 7A, between the hands 39 and 40 of the golfer which is approximately five inches down from the butt of the golf swing training device.

By keeping lines 32 and 33 equally taut, the golfer will create a perfect swing plane with the golf club 11 centrifugally balanced throughout the golfer's entire swing as shown by line A–A' in FIG. 7A.

As set forth in the Laws of Physics, Centrifugal force means the moving, proceeding, or acting in a direction away from the center or axis of an object such as its balance point.

You can alter the balance point by the reduction of pressure in either of lines 32 and 33 as shown by lines B–B' in FIG. 7B and C–C' as shown in FIG. 7C.

The perfect golf club swing and plane occurs when lines 32 and 33 are substantially equally taut as shown in FIG. 7A during the golfer's swing through approximately 360 degrees, i, e. from the top of the backswing to the finish of the swing.

Matching the plane created by lines 32 and 33 and arm member 29 of the training device with the plane created by an actual golf club through approximately 360 degree movement will create the maximum amount of energy that the particular golfer can impart to his golf ball through its golf club head.

Thus, repeated use of the golf swing training means disclosed herein will train the golfer's muscles to perform every golf club movement in practice exactly as you would like it in your regular golf club swing movement on a golf course. To achieve the best results, the exercises with the training device should be done very slowly so the golfer can sense the tension of lines 32 and 33 of sling 12 as he swings his golf club.

The best results achieved by the training device occur when use of a normal 4 count from addressing the ball to the top of the back swing and then pause. Begin the down swing with the pulling of the arms. Use the same 4 count with the downswing with 4 being the point of impact with the ball. It is desirable that the tension in lines 32 and 33 be balanced, not stretched at the top of the swing of the golf club. This keeps the golf club centrifugally balanced in its swing plane. Lines 32, 33 and 34 should be of heavy cord, or other suitable flexible material.

The line guiding means 24 forms a curved bracket formed of rigid lightweight metal or plastic so that there will be no bending or resiliency in the bracket.

When device 10 is gripped by a golfer, bracket or line guiding means 24 extends outwardly from the golfer and golf club so that it can rotate relative to portions 20 and 22 of the simulated golf club on a common axis with sufficient clearance so that no part of the bracket touches the golf club or golfer during a training exercise. The arrangement of the restraining cords or lines 32, 33 and 34 forming the sling cooperate with the bracket or line guiding means 24 and form an essential part of this invention. FIG. 1 shows a golfer in the normal position of addressing the ball and gripping device 10 in a proper manner.

The actual method of securing the ends of lines 32, 33 and 34 to the line guiding means and suction cup is of minor importance and it will be appreciated that any suitable support means or attachment may be used. The anchor position should be at the height of the head of the golfer above the ground.

The action of device 10 in maintaining equal or balanced tension in lines 32 and 33 during the start of a swing will force the golfer to develop correct hand gripping action with the balance point 37 of the training device being at a point between the hands of the golfer as shown in FIG. 7A. Assuming this position each time the training device is used will enable the golfer to obtain the proper sense and feeling for the proper swing of his or her golf club.

When lines 32 and 33 are taut with the golfer addressing the ball as shown in FIG. 1, portion 25 of the line guiding means 24 will rotate forming a plane substantially identical to the plane that the golfer should use in addressing and hitting a golf ball on the golf course.

The hands of the golfer at this time are definitely fixed in a predetermined angular position with the balance point of the training device therebetween. The arms and hands of the golfer do not change during a swing of the training device. The bracket or line guiding means 24 rotates relative to the finger gripping means of the golf club to permit the golfer to equally balance the tension in lines 32 and 33.

Thus, by equally balancing the tension in lines 32 and 33 at the top of the swing without changing the position of the golfer's grip on the simulated golf club, the arc of the swing and shafts of the golf club will not rotate. What will rotate or change its angular position with respect to the anchor point is the bracket or line guiding means 24.

It is apparent that device 10 as shown in FIG. 1 is arranged for use by a right or left handed golfer.

The improved training device disclosed enables the golfer to concentrate on swinging his or her hands through the proper arc and on maintaining them in proper position while swinging, and it has been found that once these correct swinging habits are impressed on the muscles by practice, the muscles will remember and repeat the correct swinging habits when the golfer transfers from this training device to a conventional golf club.

It should be noted that bracket or line guiding means 24, may be clamped separately to the shaft of a golf club and together with the sling formed by lines 32, 33 and 34 perform the same action as training device 10.

Although one embodiment of the invention has been illustrated and described, it will be apparent to those skilled in the art that various changes and modifications may be made therein without departing from the spirit of the invention or from the scope of the appended claims.

What is claimed is:

1. A golf swing training device comprising:

a simulated golf club comprising a hollow shaft having first and second portions, a bracket axially aligned with and spacedly interconnecting said first and second portions of said hollow shaft, said bracket comprising a part axially arranged and rotatively mounted between said first and second portions of said shaft, said bracket comprising an arm extending laterally outwardly from said part, a sling formed of a first flexible line, the ends of which are spacedly attached to said arm along its length and a second flexible line one end of which is attached to said first line midway between its ends, and the other end of which is anchorable to a vertical surface, whereby when the user of the apparatus grips said simulated golf club while facing said surface and assumes a golf ball addressing position and balances the tension in each half of said first line at a back swing position and then sequentially follows through a downswing with a centrifugally balanced golf club while maintaining both halves of said first line taut, a proper stance and swing of the golf club portion of the training device will be achieved.

2. The golf swing training device set forth in claim 1 wherein:

said first line forms an equilateral triangle with the arm of said bracket when the tension in each of said ends are equal.

3. The golf swing training device set forth in claim 1 wherein:

the balance point of said golf club when the ends of said first line are equally tensioned is at a point on said golf club between the hands of the golfer.

4. The golf swing training device set forth in claim 1 wherein:

the ends of said first line are connected to said arm for rotatable movement with said part around the axis of said shaft.

5. The golf swing training device set forth in claim 1 wherein:

the other end of said second line is anchorable to a vertical surface at a point above the head of a user.

* * * * *